US006622404B2

(12) United States Patent
Valiyambath

(10) Patent No.: US 6,622,404 B2
(45) Date of Patent: Sep. 23, 2003

(54) STEAMER ARRANGEMENT

(75) Inventor: Mohankumar Valiyambath, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 36 days.

(21) Appl. No.: 10/113,048

(22) Filed: Apr. 1, 2002

(65) Prior Publication Data

US 2002/0157288 A1 Oct. 31, 2002

(30) Foreign Application Priority Data

Apr. 4, 2001 (SG) ..... 200102515

(51) Int. Cl.[7] ..... D06F 75/40; D06F 75/10

(52) U.S. Cl. ..... 38/96; 38/77.8; 38/77.9

(58) Field of Search ..... 38/96, 77.1, 77.6, 38/77.7, 77.81, 77.8, 77.9, 79, 84, 85; 219/245, 246, 247, 254, 259, 227; 68/222; 248/117.1, 117.2

(56) References Cited

U.S. PATENT DOCUMENTS 2,568,104 A * 9/1951 Young ..... 38/77.6
2,851,050 A * 9/1958 Cissell et al. ..... 137/154
5,074,066 A 12/1991 Sakano et al. ..... 38/77.8
5,290,998 A * 3/1994 Couch et al. ..... 219/247
5,315,773 A * 5/1994 Iwami et al. ..... 38/77.6
5,428,910 A 7/1995 Gudefin et al. ..... 38/77.6
5,609,047 A * 3/1997 Hellman, Jr. et al. ..... 68/222
5,802,749 A 9/1998 Barmentlo et al. ..... 38/82

* cited by examiner

*Primary Examiner*—Ismael Izaguirre

(57) ABSTRACT

A steamer arrangement comprising a cordless steaming device (101) and a stand (1) for holding the steaming device, said steaming device having a water tank (103), said stand having an electrically heated boiler (3), said steaming device and said stand being provided with mechanical coupling means (13,105) including valves (15,107) for coupling the water tank (103) of the steaming device to the boiler (3) of the stand for obtaining a fluid communication between the boiler and the water tank when the steaming device is attached to the stand. When the steaming device is attached to the stand, steam flows from the boiler to the water tank, resulting in high-pressure/temperature steam in the water tank. Detached from the stand the cordless steaming device can be used directly for steaming. The cordless steaming device may be a cordless iron with the soleplate heated electrically, while simultaneously steam is charged when the iron is placed on the stand.

8 Claims, 2 Drawing Sheets

STEAMER ARRANGEMENT

The invention relates to a steamer arrangement comprising a cordless steaming device and a stand for holding the steaming device, said steaming device having a water tank and steam outlet ports, said stand having a water storage tank and electric heating means capable of receiving electric energy from an energy supply, said energy being used for heating said water storage tank, said steaming device and said stand being provided with mechanical coupling means including valves for coupling the water tank of the steaming device to the water storage tank of the stand for obtaining a fluid communication between the water storage tank of the stand and the water tank of the steaming device when the steaming device is attached to the stand.

Such an arrangement is known from U.S. Pat. No. 5,802,749. In most cordless irons available in the market, an electrical connection is only made between the iron and the stand for the purpose of supplying electric energy to a heating element provided in the iron for heating the soleplate. The latter then to accumulates an amount thermal energy when the iron is attached to the stand. The soleplate can be considered as a kind of accumulator. This enables the user to use the iron for a certain period of time without the iron being connected to the mains by means of a cord. In practice, however, the time for reheating the soleplate is too short, resulting in a too low soleplate temperature. The situation is even worse if the cordless iron is also suitable for steaming. To solve this problem, it is suggested in U.S. Pat. No. 5,802,749 to increase the energy transfer rate from the stand to the iron by accumulating an amount of energy in the stand and to transfer this accumulated energy to the iron when the iron is attached to the stand. It is suggested by way of example to heat liquid in the stand and to pump the heated liquid rapidly to the iron. The cooled-down liquid in the iron is pumped back to the stand for reheating. However, this kind of liquid transfer relies highly on the specific heat of the liquid, by which only relatively small quantities of energy can be stored and transferred. This limits the ironing and steaming capabilities of the cordless iron to a short period. It also requires the use of two sets of mechanical fluid couplings between the iron and the stand for fluid inlet and outlet, which presents difficulties for the user in terms of easy alignment during engagement and disengagement. Other examples, such as a flywheel and capacitors, appear to be impractical and require high-power electronics.

An object of the invention is to provide a steamer arrangement in which sufficient energy can be transferred from the stand to the cordless steaming device in order to have sufficient steam available during a usual operational in which a the user steams products continuously in each operation rest cycle, with the rest period utilized for steam charging.

The steamer arrangement according to the invention is characterized in that the water storage tank of the stand is provided with a steam space, said valves being opened when the steaming device is attached to the stand resulting in a steam flow from the water storage tank of the stand to the water tank of the steaming device, said water tank of the steaming device being provided with an outlet including a steam release valve which is connected to the steam outlet ports.

The invention makes use of a phase change between water and steam to transfer relatively large quantities of energy in terms of latent heat of vaporization, with a pressure difference as the driving force to transfer steam from the pressurized water storage tank of the stand to the water tank of the steaming device. This process is very rapid and efficient. When the steaming device is attached to the stand and the water storage tank is at a high pressure and temperature, high-pressure steam is transferred to the water tank of the steaming device. Since the temperature of the water tank of the steaming device is lower than that of the water storage tank of the stand, the steam partly condenses in the water tank until the pressures in both tanks are the same. After a short period of time the water tank of the steaming device is also pressurized and will contain water and steam under pressure, though not as high as in the water storage tank of the stand at the beginning of the transfer, but high enough to be used for steaming. The water storage tank may be heated during the steam transfer. When the steaming device is detached from the stand, electric power is supplied to the heater of the water storage tank to reheat the water. The cordless steaming device can be used for steaming the product through opening of the steam release valve.

In a preferred embodiment, the steaming device and the stand are provided with electric coupling means for transferring electric energy from the stand to the steaming device, and the steaming device is provided with electric heating means for heating water in the water tank of the steaming device when the steaming device is attached to the stand. The heating means may be, for example, an immersion heater inside the water tank or a heating element attached to or embedded in an outside wall of the water tank. Heating the water tank shortens the start-up period when the water in the water tank is relatively cold.

In another embodiment, the steaming device is provided with a hotplate and electric heating means for heating the hotplate when the steaming device is attached to the stand. Steaming devices are used for steaming objects which may sometimes have a vertical position, like curtains. A hotplate makes such a vertical ironing process easier. The hotplate touches the object only slightly during steaming. The steam outlet ports are preferably arranged in or around the hotplate, so that the steam flow is directed towards the object to be steamed. In this case, since the heat stored in the hot plate is not used for generating steam, the hotplate remains sufficiently hot for a long time.

In a further embodiment the hotplate is a soleplate of a steam iron.

These and other aspects of the invention will be apparent from and elucidated with reference to the embodiments described hereinafter.

Figure 1:
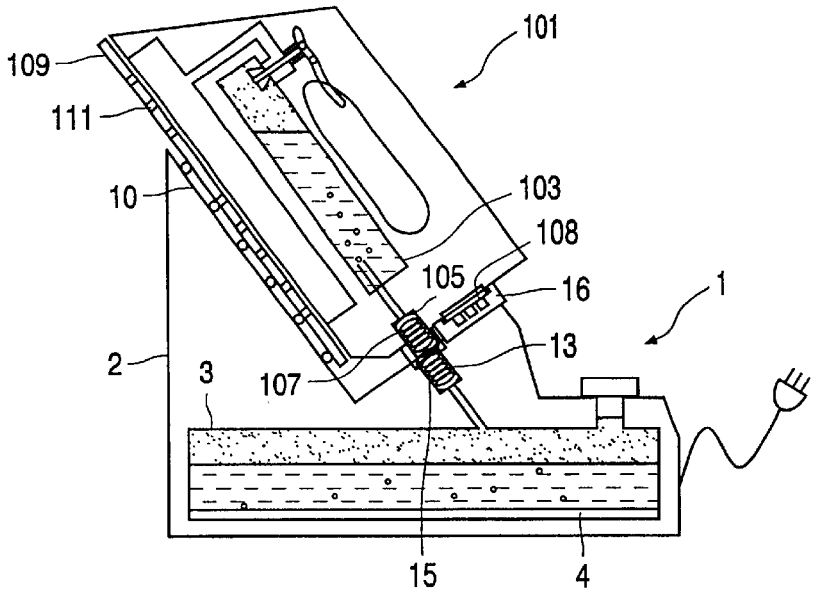
FIG. 1 shows an arrangement of a cordless iron and a stand.
Figure 3:
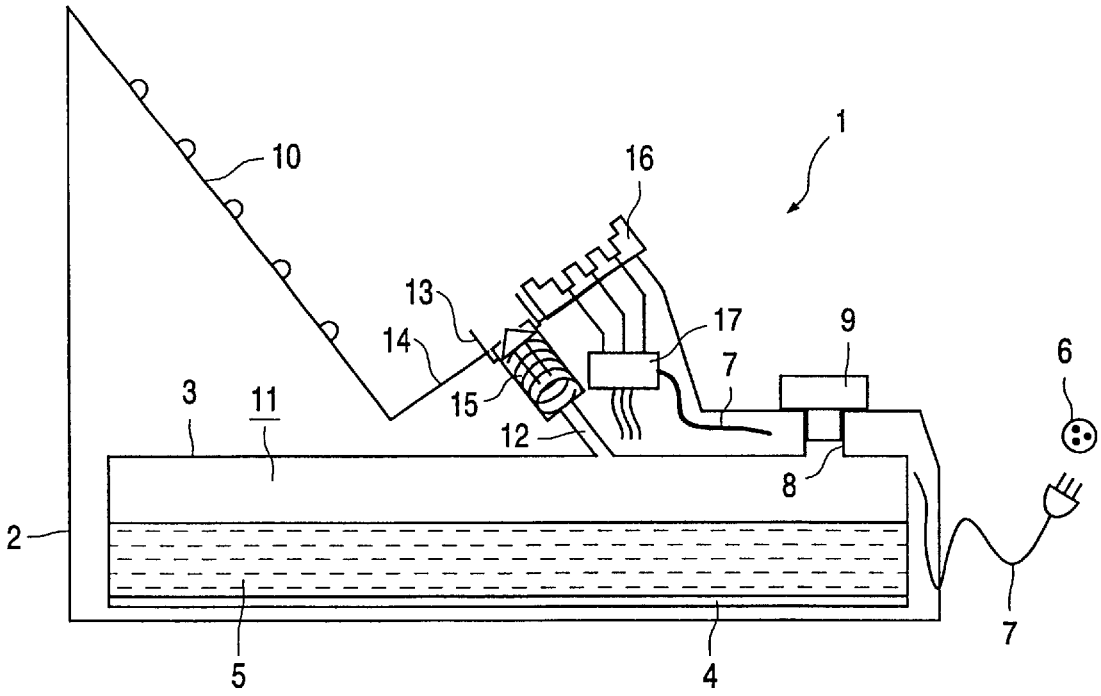
FIG. 3 shows the stand of the arrangement of FIG. 1.

As shown in FIG. 3, the stand 1 of the arrangement of FIG. 1 comprises a housing 2 in which a water storage tank or boiler 3 is located. The tank has an electric heating element 4 for heating water 5 in the tank. The electric heating element receives energy from the mains 6 via a supply cable 7. The tank has a filling opening 8 which can be closed by a cap 9. The stand comprises a inclined surface 10 with heat-resistant ribs which serves as a rest for the soleplate of the cordless iron. The water storage tank 3 comprises a steam space 11 located in an upper part of the tank. A steam outlet 12 connects the steam space 11 with a steam coupling 13 arranged at an outer wall 14 of the tank. The steam coupling comprises a valve 15 which closes the steam outlet 12 off from the open air when the iron is detached from the stand. An electric socket 16, whose electric contacts are connected to the mains via the supply cable 7, is arranged at the outer wall 14.

Figure 2:
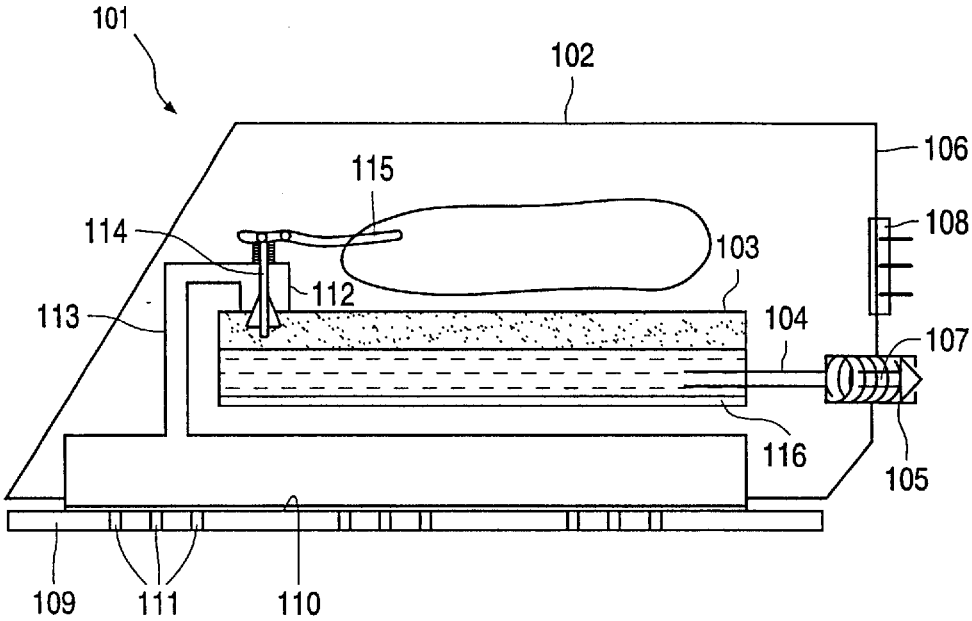
FIG. 2 shows the cordless iron of the arrangement of FIG. 1.

As shown in FIG. 2, the cordless steam iron 101 of the arrangement comprises a housing 102 in which a water tank 103 is located. The water tank has a steam inlet 104 with a steam coupling 105 arranged at an outer rear wall 106 of the iron. The steam coupling comprises a valve 107 which closes the steam inlet 104 off from the open air when the iron is detached from the stand. 106 An electric socket 108 is arranged at the outer rear wall. The iron further comprises a soleplate 109 and a heating element 110, for example a flat heating element or an embedded tubular heating element for heating the soleplate. The heating element is electrically connected to electric contacts of the electric socket 108. Steam outlet ports 111 are arranged in the soleplate. The water tank 103 has a steam outlet 112. A steam conduit 113 connects the steam outlet 112 to the steam outlet ports 111. The steam outlet 112 comprises a steam release valve 113 to control the outflow of the steam towards the steam ports. The release valve 113 is operable by means of a steam release trigger 114.

When the steam iron 101 is put on the stand 1, the soleplate 109 of the iron will bear on the inclined surface 10 of the stand and slide downward until the steam coupling 105 of the iron engages the steam coupling 13 of the stand as shown in FIG. 1. At the same time the electric socket 108 of the iron engages the electric socket 16 of the stand, thus connecting the heating element 110 to the mains. When the coupling 105 engages the coupling 13, the valves 107 and 15 automatically open.

The operation of the arrangement is as follows:

When the steam iron is attached to the stand, the soleplate 109 of the iron is heated electrically. The water 5 in the water storage tank 4 is heated or was already hot before the iron was attached to the stand. The valves 15 and 107 are open. As soon as a pressure is built up in the storage tank 4, steam is transferred to the water tank 103 of the iron. Steam condenses in the water tank 103, because the pressure and temperature are lower than in the storage tank 4. After a little while the temperature and pressure rises above 100° C. and above atmospheric pressure, respectively, until a pressure equilibrium is reached. The iron is now ready for use. Steam is directly available through opening of the release valve 114. During ironing the soleplate cools down, and the pressure and temperature in the water tank drop. During the time the iron is detached from the stand, full power is switched on to the heating element 4 of the storage tank 3 to heat the water 5 (pressure- and thermostat-controlled). When the iron is placed back on the stand, full power is supplied to the heating element 110 of the iron (thermostatically controlled). At the same time steam at high pressure is transferred to the water tank 103 of the iron, thereby raising both temperature and pressure. After a short period of time the iron is ready for ironing again.

Figure 4:
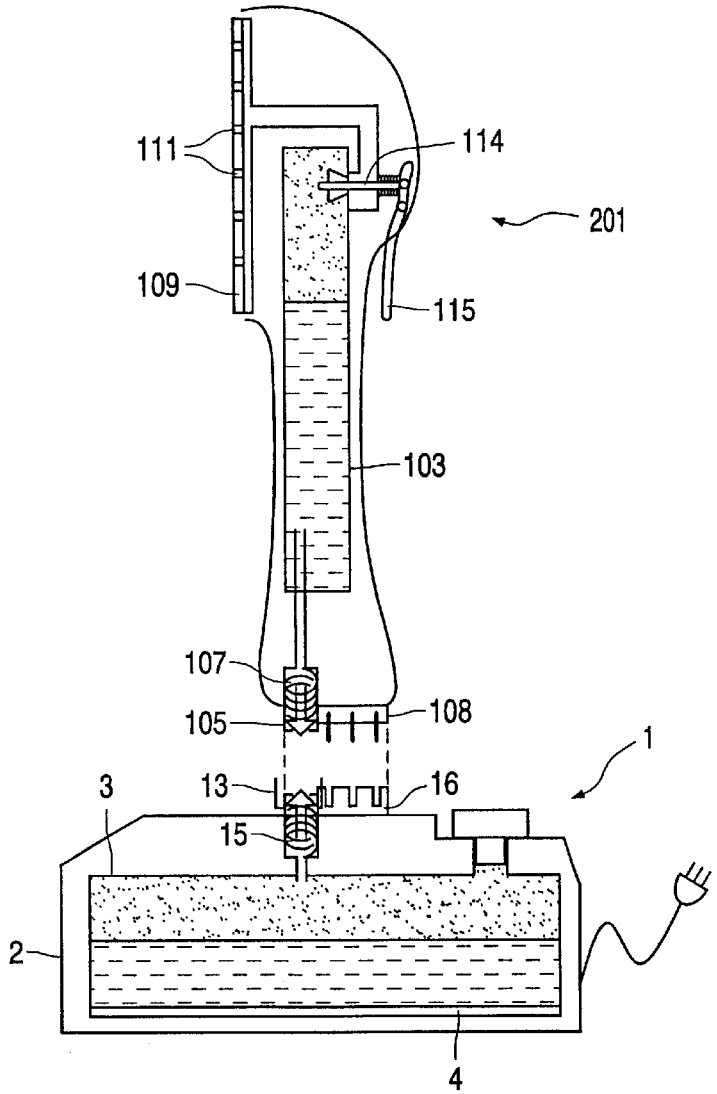
FIG. 4 shows an arrangement of a cordless steaming device and a stand.

FIG. 4 shows a cordless steaming device 201 and corresponding stand. The steaming device has similar structural elements as the iron described above. Similar parts of the two appliances have been given the same reference numerals. Only the shape is different. The steaming device can operate without a heatable hotplate. The overall steaming operation is improved when a steaming device is provided with a heatable hotplate. The working principle is the same as described above for the iron.

The water tank of both the iron and the steaming device may be optionally provided with a heating element 116. This is to enable a faster start-up and to prevent excessive condensation of steam in the water tank of the iron or steaming device when starting from the cold state. The heating should be thermostatically controlled.

The stand may comprise a control circuit 17 controlling the power to the heating elements 110 and/or 116 of the steaming device and the heating element 4 of the stand. As the power that can be drawn from the mains is limited, the control circuit may be provided with a power sequencer, i.e. switching means for switching on only one of the heating elements, so that the heating elements are never switched on simultaneously, which means that each of the heating elements can have a high power.

Additive fluids may be added to the water in the water storage tank 3 or in the path of steam in order to obtain a better ironing/steaming performance. The released steam contains the additive substance which, for example, improves wrinkling resistance, gives a starching effect, or makes a cloth hydrophylic or hydrophobic.

What is claimed is:

1. A steamer arrangement comprising a cordless steaming device and a stand for holding the steaming device, said steaming device having a water tank and steam outlet ports, said stand having a water storage tank and electric heating means which is capable of receiving electric energy from an energy supply, said energy being used for heating said water storage tank, said steaming device and said stand being provided with mechanical coupling means including valves for coupling the water tank of the steaming device to the water storage tank of the stand for obtaining a fluid communication between the water storage tank of the stand and the water tank of the steaming device when the steaming device is attached to the stand, characterized in that the water storage tank of the stand is provided with a steam space, said valves being opened when the steaming device is attached to the stand resulting in a steam flow from the water storage tank of the stand to the water tank of the steaming device, said water tank of the steaming device being provided with an outlet including a steam release valve which is connected to the steam outlet ports.

2. A steamer arrangement as claimed in claim 1, characterized in that the steaming device and the stand are provided with electric coupling means for transferring electric energy from the stand to the steaming device, and in that the steaming device is provided with electric heating means for heating water in the water tank of the steaming device when the steaming device is attached to the stand.

3. A steamer arrangement as claimed in claim 2, characterized in that the stand comprises a control circuit controlling the output to any one of the heating means.

4. A steamer arrangement as claimed in claim 1, characterized in that the steaming device is provided with a hotplate and electric heating means for heating the hotplate when the steaming device is attached to the stand.

5. A steamer arrangement as claimed in claim 3 or 4, characterized in that the hotplate is a soleplate of a steam iron.

6. A steamer arrangement as claimed in claim 4, characterized in that the hotplate is a soleplate of a steam iron.

7. A steamer arrangement as claimed in claim 1, characterized in that the water tank of the steaming device is provided with means for reducing water movement during use.

8. A steamer arrangement as claimed in claim 1, characterized in that the pressurized steam so generated is utilized to deliver a water spray or mist or an additive to a product or garment under treatment.

* * * * *